US009816404B2

(12) United States Patent
Schnell et al.

(10) Patent No.: US 9,816,404 B2
(45) Date of Patent: Nov. 14, 2017

(54) HYDRAULIC COMPENSATION ELEMENT FOR THE VALVE TRAIN OF AN INTERNAL COMPENSATION ENGINE

(71) Applicant: Schaeffler Technologies AG & Co. KG, Herzogenaurach (DE)

(72) Inventors: Oliver Schnell, Veitsbronn (DE); Peter Sailer, Erlangen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 60 days.

(21) Appl. No.: 15/048,136

(22) Filed: Feb. 19, 2016

(65) Prior Publication Data

US 2016/0341078 A1 Nov. 24, 2016

(30) Foreign Application Priority Data

May 21, 2015 (DE) ..... 10 2015 209 336

(51) Int. Cl.
*F01L 1/14* (2006.01)
*F01L 1/24* (2006.01)
*F01L 1/245* (2006.01)

(52) U.S. Cl.
CPC ..... *F01L 1/14* (2013.01); *F01L 1/2405* (2013.01); *F01L 1/245* (2013.01); *F01L 2001/256* (2013.01); *F01L 2105/00* (2013.01)

(58) Field of Classification Search
CPC . F01L 1/14; F01L 1/2405; F01L 1/245; F01L 2001/256; F01L 2105/00
USPC ..... 123/90.48, 90.52, 90.55
See application file for complete search history.

(56) References Cited

U.S. PATENT DOCUMENTS 6,615,784 B2 9/2003 Faria et al.
7,637,237 B2 * 12/2009 Evans ..... F01L 1/146 123/90.48

FOREIGN PATENT DOCUMENTS

| | | |
|---|---|---|
| DE | 10142329 | 3/2003 |
| DE | 102006017442 | 10/2007 |
| WO | 2007118820 | 10/2007 |

* cited by examiner

*Primary Examiner* — Ching Chang
(74) *Attorney, Agent, or Firm* — Volpe and Koenig, P.C.

(57) ABSTRACT

In a hydraulic compensation element for the valve train of an internal combustion engine, with a circular cylindrical housing (32) that has, in its bore (35), an axially movable pressure piston (36) with a reservoir (37) for oil as a hydraulic medium, a sleeve-like deflection element for oil is arranged in the interior of the pressure piston (36). The oil can be introduced through a radial feed hole of the housing (32), a rising channel (42), and an end-side opening (46) of the deflection element into the reservoir (37) of the pressure piston (36). The deflection element is constructed as a circular cylindrical inner sleeve (40) that has, on one axial end, an oversize dimension relative to the inner diameter of the pressure piston (36), and the inner sleeve (40) is fixed in the pressure piston (36) with a positive and non-positive fit connection.

4 Claims, 3 Drawing Sheets

HYDRAULIC COMPENSATION ELEMENT FOR THE VALVE TRAIN OF AN INTERNAL COMPENSATION ENGINE

INCORPORATION BY REFERENCE

The following documents are incorporated herein by reference as if fully set forth: German Patent Application No. 102015209336.0, filed May 21, 2015

FIELD OF THE INVENTION

The invention relates to a hydraulic compensation element for the valve train of an internal combustion engine, with a circular cylindrical housing that can be installed in a cylinder head or engine block of the internal combustion engine and that has, in its bore, an axially moving pressure piston with a reservoir for oil as a hydraulic medium, wherein, in the interior of the pressure piston there is a sleeve-like deflection element for a hydraulic medium and oil can be introduced through at least one radial feed hole of the housing, a rising channel or longitudinal channel that runs axially along the pressure piston, and an end-side opening of the deflection element into the reservoir of the pressure piston.

Such a compensation element can be constructed, for example, as a roller tappet with lateral oil supply in internal combustion engines and can be used advantageously for the suitable arrangement relative to the vertical direction with respect to its center axis.

BACKGROUND

From the published patent application DE 101 42 329 A1, a valve train for an internal combustion engine with multiple roller tappets is known. Each tappet is supported with its lower end by a rotating tappet roller on the cam of a camshaft and acts with its upper end by a push rod on a valve of the internal combustion engine.

The published patent application DE 10 2006 017 442 A1 shows and describes a hydraulic support element with the features of the compensation element of the type specified above. In this design, a sleeve-like deflection element extends almost over the total length of the pressure piston, on whose inner lateral surface it forms a sealing contact with parts of its length. For this purpose, however, a ring recess of the pressure piston is required.

SUMMARY

The invention is based on the object of providing a hydraulic compensation element with its oil supply, in which, in a sufficiently large oil reservoir, also with an arrangement of its longitudinal axis at an angle relative to the vertical, a large amount of oil can be fed and stored.

This objective is achieved according to the invention in that the deflection element is constructed as a circular cylindrical inner sleeve that has, on one axial end, a base with the end-side opening and on the other axial end is oversized relative to the inner diameter of the pressure piston, with which the inner sleeve is attached to the pressure piston in the area of an inner recess of the pressure piston with a positive and non-positive fit connection.

Such a compensation element can be constructed as a roller tappet whose housing has, on one axial end, a rotating tappet roller for contact on the cam of a camshaft.

The pressure piston of the compensation element can have, on its one axial end, a non-return valve with which its reservoir can be sealed relative to a high-pressure chamber of the housing, while the inner sleeve is arranged in the pressure piston in the area of its other axial end facing away from the non-return valve.

In this way, the rising channel can be arranged in the housing between this housing and the pressure piston located in the housing and can extend from the feed hole of the housing up to at least one passage hole of the pressure piston in the area of the inner sleeve.

BRIEF DESCRIPTION OF THE DRAWINGS

One embodiment of the invention is shown in the drawing and is described in more detail below in comparison with a previously known hydraulic element. Shown are.

DETAILED DESCRIPTION OF PREFERRED EMBODIMENTS

Figure 9:
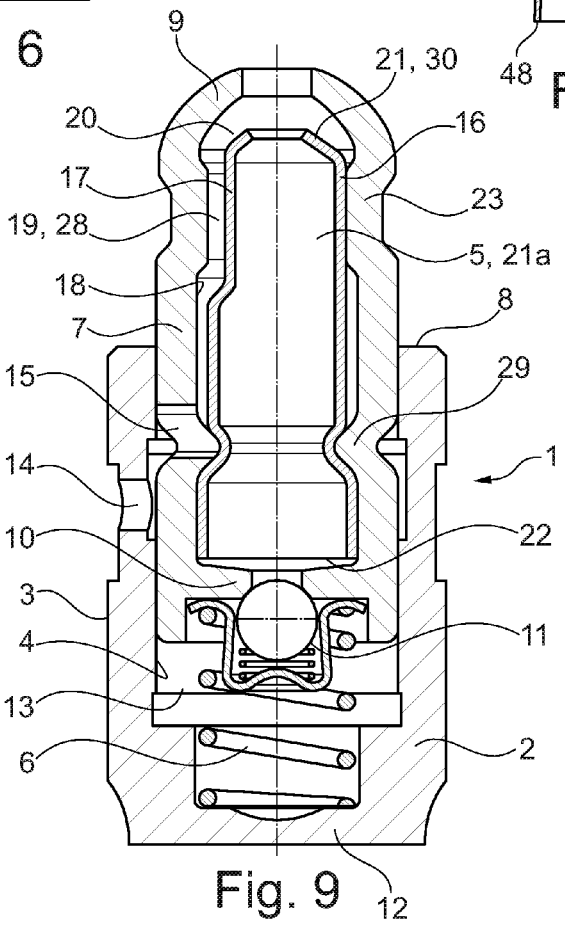
Fig. 9 (Prior Art)
FIG. 9 a hydraulic element according to the previously known prior art, in longitudinal section.

A hydraulic element 1 shown in FIG. 9 is formed from a pot-like housing 2 with an outer lateral surface 3, in whose opening 4 a pressure piston 7 is inserted so that it can move axially. The housing 2 is closed by a base 12 and can be installed in a not-shown cylinder head of an internal combustion engine. With its spherical head 9, the pressure piston 7 projects over an end face 8 of the housing 2. A finger lever can be supported on the spherical head 9 so that it can move with a pivoting motion. Axially underneath the spherical head 9, a lateral contraction 23 is arranged in the pressure piston 7. The pressure piston 7 contains a reservoir 5 for a hydraulic medium. This is bounded on the housing side by a ring base 10 with a non-return valve 11 attached to this base. Axially underneath the ring base 10 there is a high-pressure chamber 13 that is provided with hydraulic medium from the reservoir 5 via the non-return valve 11.

The pressure piston 7 is pressed out from the housing 2 by a spring element 6. In its interior, an axially almost continuous sleeve-like deflection element 16 is installed that contacts the ring base 10 with its end face 22 away from the head. Axially underneath a ring recess 29 of the pressure piston 7, the deflection element 16 forms a sealing contact on the inner lateral surface 18 of the pressure piston 7. In the area of the ring recess 29, the pressure piston 7 has an outlet 15 for hydraulic medium. This communicates with a passage 14 in the housing 2. The deflection element 16 runs with its head-side end face 21 directly underneath the spherical head 9 and has, in this area, a roof-like ring collar 30.

On its outer lateral surface 17, the deflection element 16 has, for feeding the hydraulic medium into its interior 21*a* on the side of the outlet 15, a rising path 19 that is constructed as a longitudinal channel 28. A transfer of hydraulic medium thus can be realized, starting from the passage 14, through the longitudinal channel 28 into the end area 20 and finally into the interior 21*a*.

A compensation element according to the invention shown in the other FIGS. 1 to 8 is constructed as a roller tappet 31. It has a circular cylindrical housing 32 and can act on a valve in an internal combustion engine in the installed state with its upper end area 33 by a push rod, while it can be supported with its lower end by a rotating tappet roller 34 on the cam of a camshaft. In the bore 35 of the housing 32 there is a circular cylindrical pressure piston 36 that moves in the axial direction, whose interior is provided as a reservoir 37 for a hydraulic medium. The pressure piston 36 is closed on its end facing the tappet roller 34 with a non-return valve 38 relative to a high-pressure chamber 39 located in the housing 32. In the end area 33 facing away from the tappet roller 34 and the high-pressure chamber 39 of the housing 32 there is a circular cylindrical inner sleeve 40 in the pressure piston 36.

In its middle area, the roller tappet 31 has two radial feed holes 41 of the housing 32 for the in-feed of oil as a hydraulic medium. These are connected by a rising channel 42 with radial passage holes 43 that are arranged in the pressure piston 36 in the end area 33 of the roller tappet 31. The pressure piston 36 contains the inner sleeve 40 there.

The pressure piston 36 also has, in the end area 33 facing away from the non-return valve 38, as part of the reservoir 37, a receptacle 44, into which the passage holes 43 open. In the receptacle 44 that can be seen from FIG. 4, the inner sleeve 40 is inserted axially, and first with a base 45 located on an end side, in which a central opening 46 of the inner sleeve 40 is arranged. In the pressure piston 36, in the area of the receptacle 44 there is a circular ring-shaped inner recess 47 on which the inner sleeve 40 forms a radial contact with its lateral surface in the area of its end side facing away from the base 45. There, the outer diameter of the inner sleeve 40 has an oversized area 48 relative to the inner diameter of the pressure piston 36. Therefore, the inserted inner sleeve 40 is attached there by non-positive and positive fit connections in the pressure piston 36, and thus in the roller tappet 31.

Figure 1:
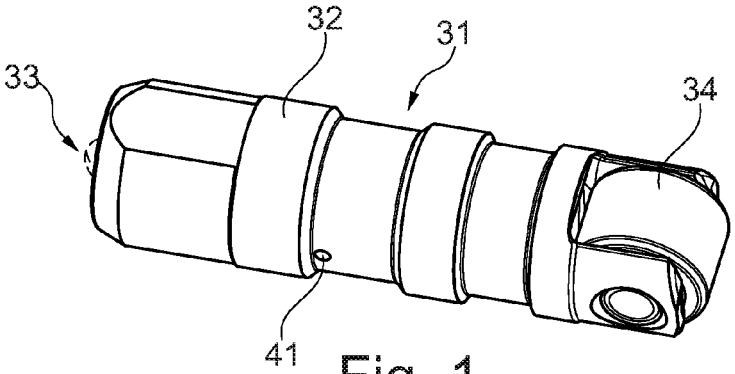
FIG. 1 a compensation element constructed according to the invention as a roller tappet in a perspective view.
Figure 2:
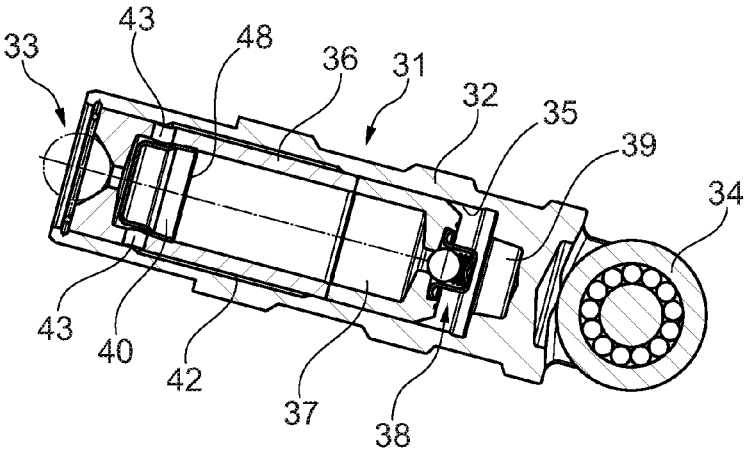
FIG. 2 the roller tappet in longitudinal section.
Figure 3:
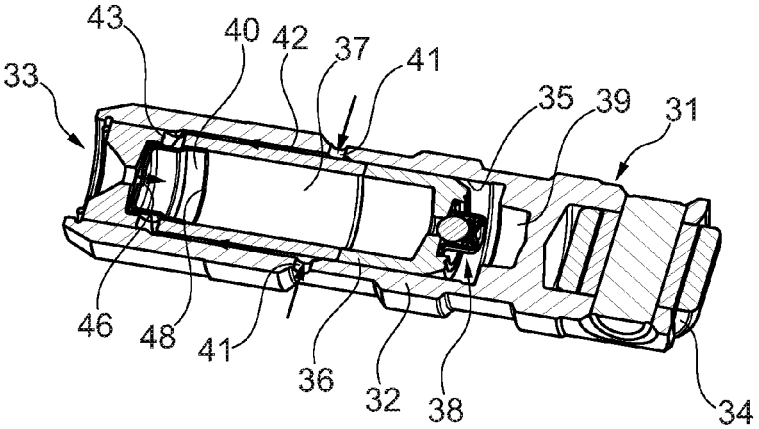
FIG. 3 the tappet part produced by a longitudinal section in perspective view.
Figure 4:
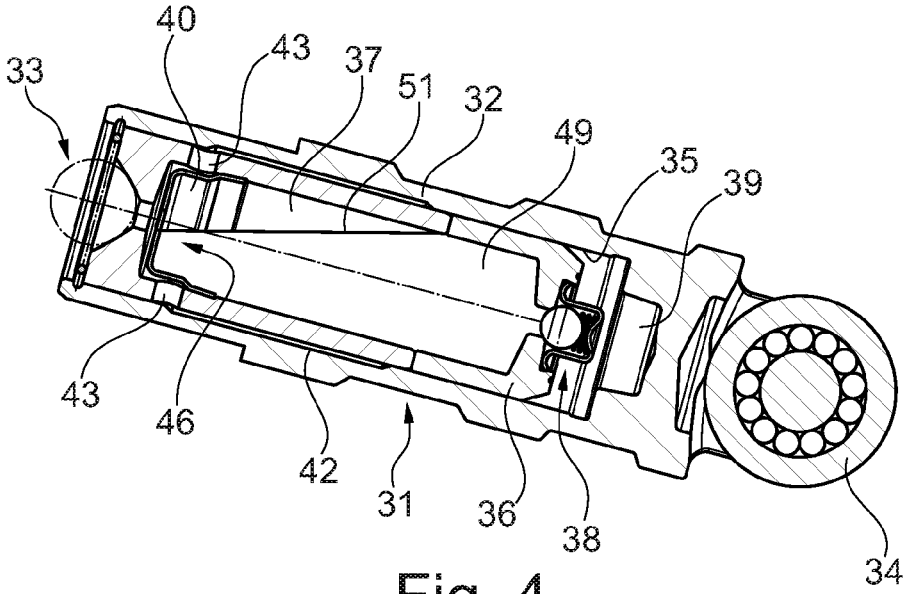
FIG. 4 the roller tappet shown in FIG. 2 with a first oil filling in its reservoir.
Figure 5:
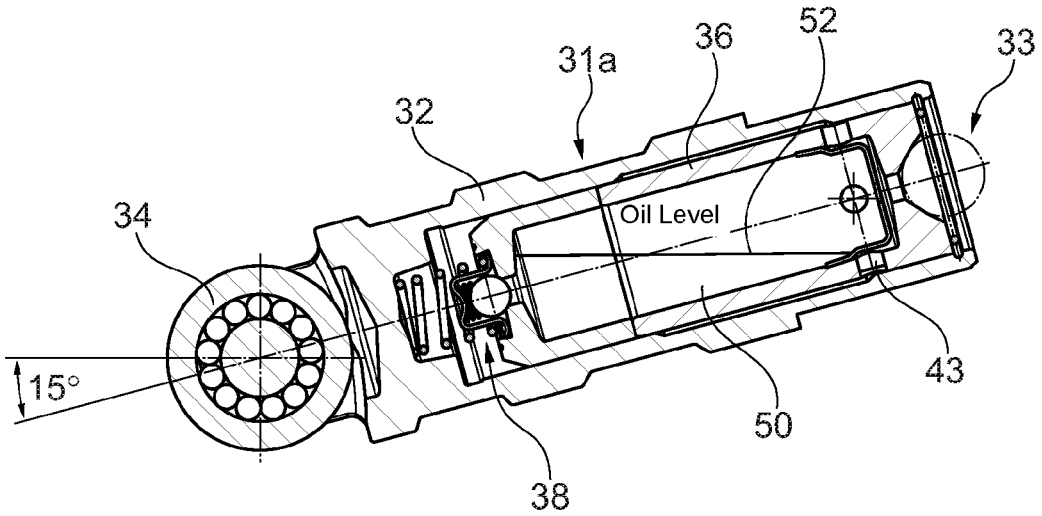
FIG. 5 a tappet that is comparable with the roller tappet according to the invention according to FIG. 4 but that has no inner sleeve with a second oil filling in its reservoir.
Figure 6:
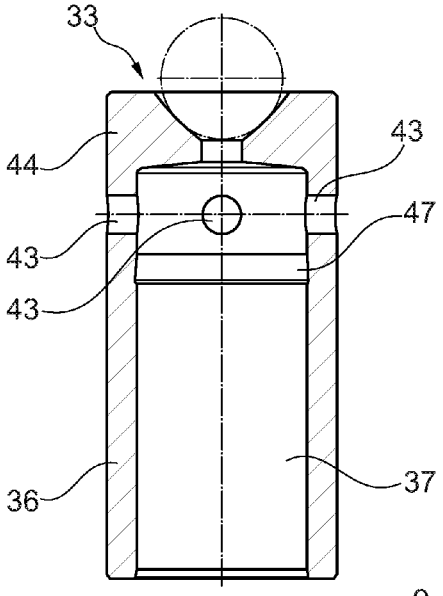
FIG. 6 a part of the pressure piston of the tappet provided for holding the Inner sleeve in longitudinal section.
Figure 7:
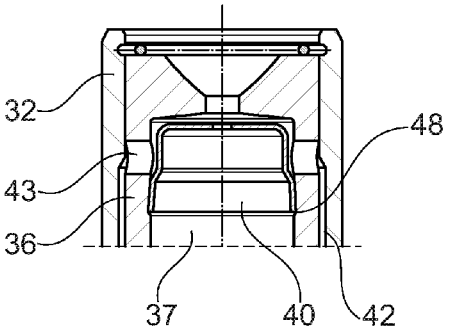
FIG. 7 the end area of the roller tappet according to the invention, into which the inner sleeve is inserted and is fixed by a positive and non-positive fit connection to its diameter having an oversize in the pressure piston, in longitudinal section.
Figure 8:
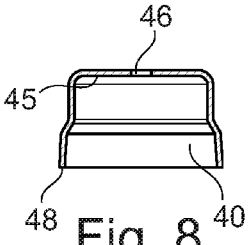
FIG. 8 the inner sleeve in longitudinal section.

In FIGS. 4 and 5, the roller tappets 31 and 31*a* are each shown in a position with a longitudinal axis inclined relative to the vertical, wherein the dimension of the inclination is 15 degrees relative to the horizontal. In FIG. 3, the path of flow of the oil to be filled into the roller tappet 31 as a hydraulic medium is shown by arrows. The oil flows through the feed holes 41 into the housing 32, through the rising channel 42 to the radial passage holes 43 in the end area 33 of the roller tappet 31, and from there to the outer side of the inner sleeve 40 through its opening 46 into the inner sleeve 40 and the reservoir 37. There it is formed, as FIG. 4 shows, as a first oil filling 49 beneath the opening 46, a horizontal oil level 51 and cannot flow out through one or more of the passage holes 43, because the access to these holes is prevented by the inner sleeve 40 according to the invention.

The roller tappet 31*a* shown in FIG. 5 and comparable with that of FIG. 4 does not contain the inner sleeve according to the invention, so that there for a second oil filling 50, the horizontal oil level 52 can be set only up to the height of the lowermost passage hole 43. The quantity of the second oil filling 50 is therefore less than the quantity of the first oil filling 49 of the roller tappet 31 in FIG. 4. With the inner sleeve 40 according to the invention in FIG. 4, in the reservoir 37 it is possible to maintain a large oil quantity in the roller tappet 31 and in this way the objective forming the basis of the invention is achieved.

LIST OF REFERENCE SYMBOLS

1 Support element
2 Housing
3 Outer lateral surface
4 Bore
5 Reservoir
6 Spring element
7 Pressure piston
8 End face
9 Ball head
10 Ring base
11 Non-return valve
12 Bottom
13 High-pressure chamber
14 Passage
15 Outlet
16 Deflection element
17 Outer lateral surface
18 Inner lateral surface
19 Rising path
20 End area
21 Head-side end face
21*a* Interior
22 End face away from head
23 Lateral contraction
28 Longitudinal channel
29 Ring molding
30 Ring collar
31 Roller tappet
31*a* Roller tappet
32 Housing
33 End area
34 Tappet roller
35 Bore
36 Pressure piston
37 Reservoir
38 Non-return valve
39 High-pressure chamber
40 Inner sleeve
41 Feed hole
42 Rising channel
43 Passage hole
44 Receptacle
45 Bottom
46 Opening
47 Inner recess
48 Oversized area
49 First oil filling
50 Second oil filling
51 Oil level
52 Oil level

The invention claimed is:

1. A hydraulic compensation element for the valve train of an internal combustion engine, comprising a circular cylindrical housing that is installable in a cylinder head or engine block of the internal combustion engine and has a bore, an axially movable pressure piston with a reservoir for oil as a hydraulic medium is located in the bore, a sleeve-like deflection element for a hydraulic medium is arranged in an interior of the pressure piston, at least one radial feed hole located in the circular cylindrical housing for oil to be introduced into housing from the at least one radial feed hole, a rising channel extends axially along the pressure piston, and an end-side opening located in the deflection element that leads into the reservoir of the pressure piston, the deflection element comprises a circular cylindrical inner sleeve that has, on one axial end, a bottom with the end-side opening and on an other axial end an oversized area that is greater than an inner diameter of the pressure piston, with which the inner sleeve is fixed in the pressure piston in an area of an inner recess of the pressure piston with a positive and non-positive fit connection.

2. The compensation element according to claim 1, wherein the compensation element is constructed as a roller tappet and the housing has, on one axial end, a tappet roller that is supported for rotation for contact on a cam of a camshaft.

3. The compensation element according to claim 1, wherein the pressure piston has, on one axial end, a non-return valve, with which the reservoir is closeable relative to a high-pressure chamber of the housing, and the inner sleeve is arranged in the pressure piston in an area of an other axial end of the pressure piston that faces away from the non-return valve.

4. The compensation element according to claim 1, wherein the rising channel is arranged in the housing between the housing and the pressure piston located in the housing and extends from the feed hole of the housing up to at least one passage hole of the pressure piston in an area of the inner sleeve.

* * * * *